US008256767B2

(12) United States Patent
Williams et al.

(10) Patent No.: US 8,256,767 B2
(45) Date of Patent: Sep. 4, 2012

(54) SHEET REGISTRATION USING EDGE SENSORS

(75) Inventors: Lloyd A. Williams, Mahopac, NY (US); Joannes N. M. deJong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 278 days.

(21) Appl. No.: 12/641,860

(22) Filed: Dec. 18, 2009

(65) Prior Publication Data

US 2011/0148033 A1 Jun. 23, 2011

(51) Int. Cl.
*B65H 7/02* (2006.01)

(52) U.S. Cl. ..... 271/228; 271/227

(58) Field of Classification Search ..... 271/226, 271/227, 228, 249, 252
See application file for complete search history.

(56) References Cited

U.S. PATENT DOCUMENTS

| | | | | | |
|---|---|---|---|---|---|
| 4,971,304 | A | | 11/1990 | Lofthus | |
| 5,094,442 | A | | 3/1992 | Kamprath et al. | |
| 5,169,140 | A | | 12/1992 | Wenthe, Jr. | |
| 5,219,159 | A | | 6/1993 | Malachowski et al. | |
| 5,278,624 | A | | 1/1994 | Kamprath et al. | |
| 5,678,159 | A | * | 10/1997 | Williams et al. | 399/395 |
| 5,697,608 | A | * | 12/1997 | Castelli et al. | 271/228 |
| 5,697,609 | A | * | 12/1997 | Williams et al. | 271/228 |
| 5,715,514 | A | * | 2/1998 | Williams et al. | 399/395 |
| 5,794,176 | A | | 8/1998 | Milillo | |
| 6,137,989 | A | | 10/2000 | Quesnel | |
| 6,168,153 | B1 | | 1/2001 | Richards et al. | |
| 6,374,075 | B1 | * | 4/2002 | Benedict et al. | 399/395 |
| 6,533,268 | B2 | | 3/2003 | Williams et al. | |
| 6,575,458 | B2 | | 6/2003 | Williams et al. | |
| 6,634,521 | B1 | * | 10/2003 | Hwang | 221/228 |
| 7,422,210 | B2 | * | 9/2008 | Dejong et al. | 271/228 |
| 7,422,211 | B2 | * | 9/2008 | Dejong et al. | 271/249 |
| 2003/0146567 | A1 | | 8/2003 | Williams et al. | |
| 2006/0239733 | A1 | * | 10/2006 | Choi et al. | 399/396 |
| 2008/0012214 | A1 | * | 1/2008 | Elliot | 271/227 |
| 2008/0012215 | A1 | * | 1/2008 | Elliot | 271/228 |
| 2008/0193148 | A1 | | 8/2008 | Bonino | |
| 2009/0020941 | A1 | | 1/2009 | deJong et al. | |

* cited by examiner

*Primary Examiner* — Jeremy R Severson
(74) *Attorney, Agent, or Firm* — Hoffmann & Baron, LLP

(57) ABSTRACT

Accurate sheet registration is achieved by measuring the arrival of a leading edge and/or a trailing edge of the sheet using a first sensor. Also, measuring a first position of the sheet using a second sensor on a lateral edge of the sheet. Then performing a first adjustment moving the sheet laterally using the first position measurement. The first adjustment actuated prior to the sheet reaching a third sensor for measuring a second position of the sheet. The third sensor disposed downstream in the process direction of the second sensor and a sheet feeding nip. Then measuring a second position of the sheet using the third sensor on the lateral edge and performing a second adjustment of the sheet with regard to at least one of sheet skew, sheet velocity and sheet lateral position using at least one of the arrival, first position and second position measurements.

18 Claims, 5 Drawing Sheets

SHEET REGISTRATION USING EDGE SENSORS

TECHNICAL FIELD

The presently disclosed technologies are directed to apparatus, systems and methods of accurately registering a substrate media sheet in a media handling assembly, such as a printing system. The various embodiments herein also relate to the use of sheet edge sensors for accurate sheet registration.

BACKGROUND

In media handling assemblies, particularly in printing systems, accurate and reliable registration of the substrate media as it is transferred in a process direction is desirable. In particular, accurate registration of the substrate media, such as a sheet of paper, as it is delivered at a target time to an image or ink transfer zone will improve the overall printing process. There are at least three degrees of freedom in which the substrate media can move, which need to be controlled in order to achieve accurate delivery thereof. Accurate sheet registration refers to the control or correction of those degrees of freedom in order to deliver a sheet as precisely desired. The substrate media is generally conveyed within the system in a process direction. However, often the substrate media can shift in a cross-process direction that is lateral (side ways) relative to the process direction. Also, the sheet can even acquire and angular orientation, referred herein as "skew," such that it's opposed lateral edges are no longer parallel to the process direction. Further, the sheet velocity may need adjusting in order to timely arrive at a delivery or transfer point (a datum) with a desired speed.

A slight skew, lateral misalignment or arrival time or velocity error of the substrate media through a critical processing phase can lead to errors, such as image and/or color registration errors relating to such arrival at a printing station. Contemporary systems transport a sheet and deliver it at a target time to a "datum," based on measurements from one or more of the sheet's edges. The datum can be a particular point in a transfer zone, a hand-off point to a downstream nip assembly or any other target location within the media handling assembly. The edge measurements generally determine whether registration errors exist, in order to correct them prior to delivery at the datum. As the substrate media is transferred between sections of the media handling assembly, without registration measurements and corrections the amount of registration error can increase or accumulate, causing pushing, pulling or shearing forces to be generated, which can wrinkle, buckle or even tear the sheet(s).

FIG. 7 is a schematic example of a contemporary sheet registration system. The sheet registration system consists of two sets of drive nips, an inboard nip 20 and an outboard nip 30. The nips 20, 30 are mounted with bearings on a shaft 25 so that they are free to rotate. An angular velocity is imparted to each driven nip wheel with a motor, generally controlled by a processing device, referred to as the controller (not shown). Also, the nips 20, 30 are often mounted such that they can be moved laterally along a y-axis. In fact, the motors, nips and related assemblies can all be mounted on a carriage that can move along the y-axis in order to collectively correct lateral registration errors of a sheet engaged by the nips 20, 30, as is further disclosed in U.S. Pat. No. 5,094,442 by Kamprath et al. U.S. Pat. Nos. 6,533,268 and 6,575,458 disclose alternative mechanisms for adjusting a sheet's lateral position with an appropriate actuator. These contemporary methods more generally disclose that the nip assemblies can be used to move the sheet in three degrees of freedom, i.e. process, lateral and skew, in order to achieve proper sheet registration.

The skew orientation and time at arrival of a sheet leading edge $L_E$ into a sheet registration system is typically measured by two laterally spaced leading edge sensors Si, So located just downstream of and immediately adjacent to the registration nips 20, 30. A sheet velocity actuator commanded by the controller then executes a command profile in order to timely deliver the sheet to the datum with a prescribed sheet velocity. The sheet velocity can be temporarily sped up or slowed down in order to arrive at the datum at the correct time, with a further change to a target velocity just before delivery. Also, the controller can prescribe different velocities Vi, Vo for the nips 20, 30 to generate, in order to deliver the sheet to the registration datum D with a particular skew or lack thereof. By adjusting the difference between the inboard and outboard sheet velocities Vi, Vo, a skew velocity rotates the sheet as desired, which is used to achieve sheet skew registration. In this way, laterally spaced apart differentially driven drive rollers that are part of the nips 20, 30 are used to adjust a sheet delivery time, velocity and orientation.

In order to print onto both sides in a duplex printing environment, the sheet gets inverted, thus making the previously trailing edge $T_E$ the new leading edge. Unfortunately, sheet cut errors often cause the leading and trailing edges to be non-parallel. This introduces improper skew error measurements if the leading edge sensors Si, So are used for skew measurements of the second side. Thus, contemporary systems provide side edge sensors E1, E2 in order to measure skew using a common side edge. While such a system only needs one leading edge sensor, with all the edge measurements (leading edge and side edge) being taken when the sheet first enters the nips 20, 30, the system is limited to open loop control. In other words, continuous or repeated monitoring and/or adjustment of sheet registration between the leading edge sensors Si, So and the delivery datum D (referred to as closed loop control) can not be performed. Alternative contemporary systems place the second side edge sensor E2 downstream of the nips 20, 30, but well before the datum D, which enables closed loop control. However, positioning the second side edge sensor E2 downstream of the nips 20, 30 has the disadvantage that skew control can not start until the edge of the sheet reaches the downstream sensor E2. This delays or doesn't leave very much time or distance to make corrections before the sheet reaches the datum D. While two leading edge sensors Si, So can once again be used to measure initial skew, the above noted errors in a duplex environment limit the effectiveness of such a system. Also, this increases the number of required sensors, which increases production and maintenance costs.

Accordingly, it would be desirable to provide a system for and method of accurately registering a sheet in a media handling assembly, which overcomes the shortcoming of the prior art.

SUMMARY

According to aspects described herein, there is disclosed a method of registering a sheet moved substantially in a process direction along a substrate media handling assembly path. A lateral direction extending sideways relative to the process direction. Accurate sheet registration is achieved by measuring the arrival of a leading edge and/or a trailing edge of the sheet using a first sensor. Also, measuring a first position of the sheet using a second sensor on a lateral edge of the sheet. Then performing a first adjustment moving the sheet laterally using the first position measurement. The first adjustment actuated prior to the sheet reaching a third sensor for measuring a second position of the sheet. The third sensor disposed downstream in the process direction of the second sensor and a sheet feeding nip. Then measuring a second position of the sheet using the third sensor on the lateral edge and performing a second adjustment of the sheet with regard to at least one of sheet skew, sheet velocity and sheet lateral position using at least one of the arrival, first position and second position measurements.

Additionally, the first adjustment can be substantially complete by the time the sheet reaches the third sensor. The first adjustment can also be completed prior to the sheet reaching the third sensor. The second position measurement can be taken by the second and third sensors upon the sheet reaching the third sensor. The second adjustment can be executed using the arrival measurement to modify the sheet process velocity. The handling assembly can include duplex handling, whereby the leading edge arrival measurement can be taken for a first sheet side and the trailing edge arrival measurement can be taken for an opposed second sheet side. The arrival measurement can coincide with the sheet being engaged by the sheet feeding nip. The first sensor can be one of a plurality of trailing edge sensors, whereby the number of trailing edge sensors included can be determined by a ratio of a sheet length differential over a distance between the third sensor and the sheet feeding nip. The third sensor can be disposed closer in the process direction to a downstream delivery datum than to the sheet feeding nip. A constant sheet velocity can be maintained as part of the first adjustment.

According to other aspects described herein, there is provided an apparatus for registering a sheet moved substantially in a process direction along a substrate media handling assembly path. A lateral direction extends sideways relative to the process direction. The apparatus includes first, second and third sensors, as well as a controller. The first sensor measuring the arrival of at least one of a leading edge and a trailing edge of the sheet. The second sensor measuring a first position of a lateral edge of the sheet. The third sensor measuring at least one second position of the lateral edge of the sheet. The third sensor disposed downstream in the process direction of the second sensor and a sheet feeding nip. The controller operatively connected to the sheet feeding nip and the first, second and third sensors. The controller initiates a first adjustment, whereby the sheet moves laterally using the first position measurement. The first adjustment being actuated prior to the sheet reaching the third sensor. The controller then initiates a second adjustment of the sheet with regard to at least one of sheet skew, sheet velocity and sheet lateral position using at least one of the arrival, first position and second position measurements.

Additionally, the first adjustment can be substantially complete by the time the sheet reaches the third sensor. The first adjustment can be completed prior to the sheet reaching the third sensor. The second position measurement can be taken by the second and third sensors upon the sheet reaching the third sensor. The second adjustment can be executed using the arrival measurement to modify the sheet process velocity. The handling assembly can include duplex handling, whereby the leading edge arrival measurement can be taken for a first sheet side and the trailing edge arrival measurement can be taken for an opposed second sheet side. The arrival measurement can coincide with the sheet being engaged by the sheet feeding nip. The first sensor can be one of a plurality of trailing edge sensors, whereby the number of trailing edge sensors included can be determined by a ratio of a sheet length differential over a distance between the third sensor and the sheet feeding nip. The third sensor can be disposed closer in the process direction to a downstream delivery datum than to the sheet feeding nip. A constant sheet velocity can be maintained as part of the first adjustment.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
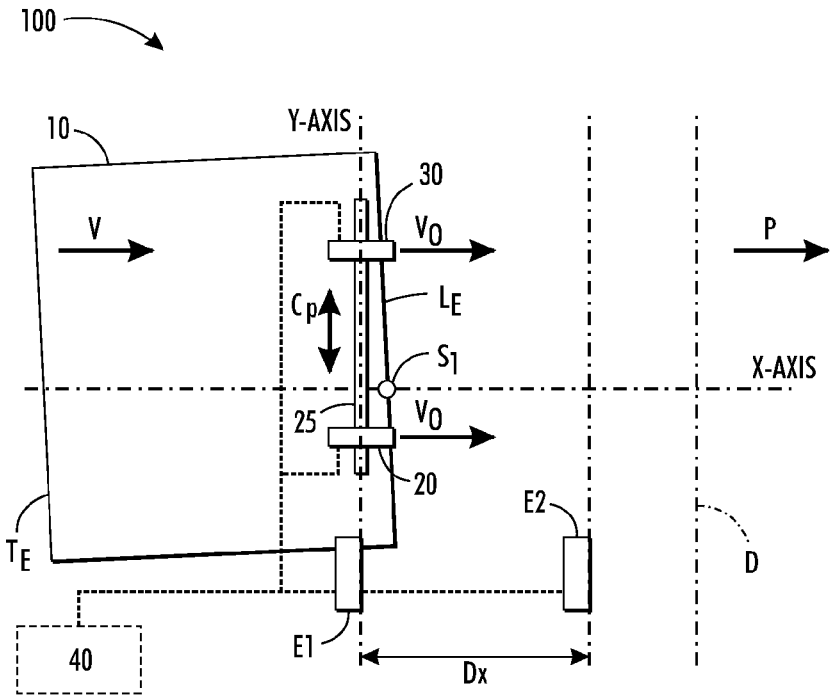
FIG. 1 is a schematic plan view of an apparatus for registering a sheet in a substrate media handling assembly, with the sheet initially entering the sheet feeding nips, in accordance with an aspect of the disclosed technologies.

Describing now in further detail these exemplary embodiments with reference to the Figures. In accordance with aspects of the technologies disclosed herein, apparatus, systems and methods are disclosed for precise sheet registration using edge sensors. It should be understood that these apparatus, systems and methods can be used in one or more select locations of the paper path or paths of various conventional media handling assemblies. Thus, only a portion of an exemplary media handling assembly path are illustrated and discussed herein. Also, it should be noted that the apparatus, systems and methods described below are not particular to the kind of actuators used to register the sheet.

Aspects of the disclosed technologies relate to a method of and apparatus for registering a sheet which reduces the number of sensors that are required. For leading edge registration, one sensor measures the lead edge arrival of the sheet. Also, a sheet lateral edge position is measured by a single first lateral edge sensor. Subsequently, the registration controller executes a first adjustment moving the sheet to correct lateral position errors and possibly process timing or velocity errors. The first adjustment is targeted to be completed at a certain percentage of the total distance available before the sheet reaches a second lateral edge sensor. At that time, a lateral edge of the sheet is also measures by that second lateral edge sensor, whereby a skew measurement becomes available. The leading edge measurement can thereafter be corrected by the information obtained from the skew and lateral measurements. A second adjustment of the sheet can be executed to register the sheet in skew, velocity and lateral position. For trail edge registration, trail edge sensors are positioned such that the trail edge is measured during the first part of the move. As with the lead edge sensor, the timing of the trail edge sensor is corrected for skew and lateral positioning when the measurement is available from the second lateral edge sensor. Spacing of these trail sensors can therefore be larger, thereby reducing the number of sensors required at a significant cost savings.

As used herein, a "printer," "printing assembly" or "printing system" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system as referred to herein are synonymous and can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printer can print and/or handle monochrome or color image data, as well as transfer or impress marks by indenting or raising a surface.

As used herein, "sheet," "sheet of paper" or "substrate media" are used interchangeably and refer to, for example, paper, transparencies, parchment, film, fabric, plastic, photo-finishing papers or other coated or non-coated substrate media in the form of a web upon which information or markings can be visualized and/or reproduced. While specific reference herein is made to a sheet or paper, it should be understood that any substrate media in the form of a web amounts to a reasonable equivalent thereto. Also, the "leading edge" of a sheet refers to an edge of the sheet that is furthest downstream in the process direction. In contrast, the "trailing edge" of a sheet refers to an edge of the sheet opposed to the leading edge and furthest upstream in the process direction. The term "side edge" or "side edges" refer to the sheet edges extending between the leading and trailing edges.

As used herein, a "media handling assembly" refers to one or more devices used for handling and/or transporting substrate media, including feeding, printing, finishing, registration and transport systems.

As used herein, "sensor" refers to a device that responds to a physical stimulus and transmits a resulting impulse in the form of a signal for the measurement and/or operation of controls. Such sensors include those that use pressure, light, motion, heat, sound and magnetism. Also, each of such sensors as refers to herein can include one or more sensors for detecting and/or measuring characteristics of a substrate media, such as speed, orientation, process or cross-process position and even the size of the substrate media. Thus, reference herein to a "sensor" can include more than one sensor.

As used herein, a "nip," "nip assembly," "registration nip" or "sheet feeding nip" are used interchangeably herein and refers to a subassembly that includes a drive roller and an idler roller. When a sheet is being handled by the nip, the drive and idler rollers engage opposing faces of the sheet, thereby grabbing and moving the sheet through at least a portion of the overall media handling assembly. The drive roller is supported by a drive shaft and the idler roller is supported by a separate idler shaft. Thus, at least a drive roller, drive shaft, idler roller and idler shaft are considered part of each nip.

As used herein, "skew" refers to a physical orientation of the sheet (substrate media) relative to the media handling assembly path in which it is being handled. In particular, skew refers to a misalignment, slant or oblique orientation of an edge of the substrate media relative to a process path.

As used herein, the terms "process" and "process direction" refer to a process of moving, transporting and/or handling a substrate media. The process direction substantially coincides with a direction of a flow path P along which the substrate media is primarily moved within the media handling assembly. Such a flow path P is said to flow from upstream to downstream. A "lateral direction" or "cross-process direction" are used interchangeably herein and both refer to at least one of two directions that generally extend sideways relative to the process direction. From the reference of a sheet handled in the process path, an axis extending through the two opposed side edges of the sheet and extending perpendicular to the process direction is considered to extend along a lateral or cross-process direction. With reference to the orientation of the drawings in FIGS. 1-5 and 7, a lateral direction is either up or down.

It should be noted that the illustrative drawings herein are not to scale. In fact, the angles and distances between surfaces depicted are generally exaggerated in order to more easily visualize and explain the methods, systems and apparatus in accordance with the disclosed technologies.

The particular aspects of the disclosed technologies are described below with reference to the drawings herein. However, it should be understood that such illustrations are non-limiting examples of those aspects and are merely included to illustrate at least some embodiments. The embodiments described herein are not intended to limit the scope of the invention herein.

FIG. 1 is a schematic plan view of an apparatus for registering a sheet in a substrate media handling assembly. A sheet 10 is shown initially entering a pair of sheet feeding nips 20, 30. In FIG. 1, arrow P represents the primary direction of flow of the sheet 10, which corresponds to the process direction, from an upstream location toward a downstream location. In this way, the sheet 10 generally travels through the pair of registration nips 20, 30, together having a central axis 25, which coincides with the axis of both the nip drive and idler rolls. The central nip axis 25 extends in a lateral direction L, coincident with the Y-axis as shown. The diameter or width of the individual drive or idler rolls can be varied as necessary for the particular application of the presently disclosed technologies. Perpendicular to the Y-axis is the process direction, which extends along and is parallel to the X-axis as shown.

The system 100 includes a leading edge sensor S1 that is preferably positioned downstream and close to the nips 20, 30, as shown, but need not be positioned between the nips. Also, while additional leading edge sensors can be used, they are not necessary according to an aspect of the disclosed technologies. The position of the leading edge sensor S1 is generally in close proximity to the nips 20, 30. The sensor S1 detects the presence of a sheet 10, starting when a portion along the sheet leading edge $L_E$ crosses the sensor S1. Accordingly, the time when the leading edge $L_E$ crosses over the sensor S1 is generally associated with the arrival of that sheet 10 to that position or reaching that point in the process. By placing the sensor S1 downstream relative to the nips 20, 30, the arrival at the position of the sensor S1 in the process direction can also be associated with the point where the sheet 10 is at least partially engaged by the nips 20, 30. Also, once the presence of the sheet 10 is detected, the nips 20, 30 only have a limited time of engagement with that sheet 10 in which to manipulate and/or adjust its position, orientation or speed. Thus, while it is desirable to place the sensor S1 as close as possible in the process direction to the nips 20, 30, such a sensor could be positioned closer or further from the nips 20, 30 as desired for a particular application. Also, the sensor S1 could potentially be positioned on the upstream side of the nips 20, 30, with actual engagement of the sheet S in the nips 20, 30 being assumed or estimated immediately thereafter.

Additionally, provided are lateral edge sensors E1, E2, which can measure where a lateral sheet edge is disposed relative to the lateral width of the process path. Examples of such lateral edge sensors include CCD array sensors (edge registered); long range angled Contact Image Sensors (CIS—center registered); point sensors modified to have an analog range (edge registered); moveable point sensors (center registered) or others as are common in the art. One of the lateral edge sensors E1 is shown positioned on or at least immediately adjacent to the central nip axis 25. However, sensor E1 can be positioned further downstream or upstream, if desired. Another lateral edge sensor E2 is positioned downstream from the first lateral edge sensor E1. An offset Dx represents the distance between the central nip axis 25 and the downstream lateral edge sensor E2. Also, where the upstream lateral edge sensor E1 is coincident with the nip axis 25, then DX also represents the distance between the two sensors E1, E2 in the process direction. It should be appreciated that while a small circle is shown to represent leading edge sensor S1 and rectangular shapes shown to represent the lateral edge sensors E1, E2, almost any sheet edge sensing device can be used to detect sheet edge arrival or position and/or other characteristics of the substrate media in accordance with the disclosed technologies.

A controller 40 is used to receive sheet information from lateral edge sensors E1, E2, leading edge sensor S1 and any other available input that can provide useful information regarding the sheet(s) 10 being handled in the system. The controller 40 can include one or more processing devices capable of individually or collectively receiving signals from input devices, outputting signals to control devices and processing those signals in accordance with a rules-based set of instructions. The controller 40 can then transmit signals to one or more actuation systems, such as a laterally actuated translation carriage or the nips 20, 30 (particularly the drive nips). Thus, based on the position, orientation and velocity of the sheet input into the controller, output commands can be transmitted to properly register the sheet by the time it arrives at the datum D in accordance with aspects described herein.

FIG. 1 shows the leading edge $L_E$ of a sheet 10 that has arrived at the leading edge sensor S1. At this point, the sensor S1 will measure the lead edge arrival time. This arrival time can be used to more accurately time the delivery of the sheet at the downstream datum D. The sheet velocity V can be controlled by the nips 20, 30 speeding up and/or slowing down as they feed the sheet past this portion of the assembly 100, as part of the registration process. Also at this position along the process path, although the sheet 10 has not yet reached the downstream lateral edge sensor E2, it has reached the more upstream lateral edge sensor E1 that can measure a first position of the sheet 10. This first position represents a rough measure of the sheet's location relative to the process path and particularly the combined nips 20, 30. It is characterized as a rough measure because only two points on two different edges have been measured (one from the leading edge sensor S1 and the other from the first lateral edge sensor E1). If the sheet 10 is skewed, these initial measurements don't necessarily take that into account. Nonetheless, in accordance with an aspect of the disclosed technologies, the registration controller 40 at this point will execute a first adjustment of the sheet. That first adjustment particularly involves a rough lateral shift of the sheet's position. Thus, for example, this initial rough lateral shift can bring the sheet 10 to within 1 mm of a desired lateral sheet position. This first adjustment uses at least the measurement taken by the first lateral edge sensor in order to perform an estimated correction of the sheet's position laterally. As shown in FIG. 1, the nips 20, 30 impart the same velocity Vo, which thus maintains a constant velocity at least until the sheet 10 reaches the downstream lateral edge sensor E2. The first adjustment can alternatively include a skew correction or sheet velocity change, but the measurements taken at this point with regard to sheet skew or velocity are more susceptible to errors and thus need not be included at this stage.

Figure 2:
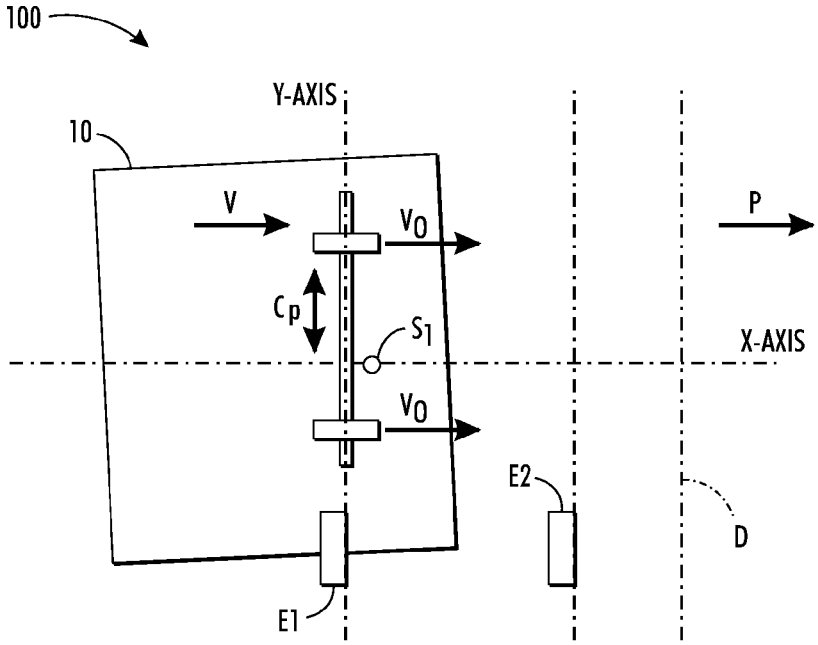
FIG. 2 is a schematic plan view as shown in FIG. 1, with the sheet further downstream and laterally adjusted in accordance with an aspect of the disclosed technologies.

FIG. 2 shows the sheet 10 having progressed a little further downstream along the process direction P. Also, the sheet lateral position has been adjusted. Based on the orientation of the drawings, the sheet shifted downward, which corresponds to a lateral direction toward the lateral edge sensors. It should be understood that if desired the first adjustment of the sheet 10 could have been in the opposite direction, toward the outboard side of the assembly (the upper part of the drawing). This first adjustment can be substantially complete by the time the sheet 10 reaches the second lateral edge sensor E2. The controller can even be programmed to ensure that this first adjustment is completed before the sheet 10 reaches sensor E2.

Figure 3:
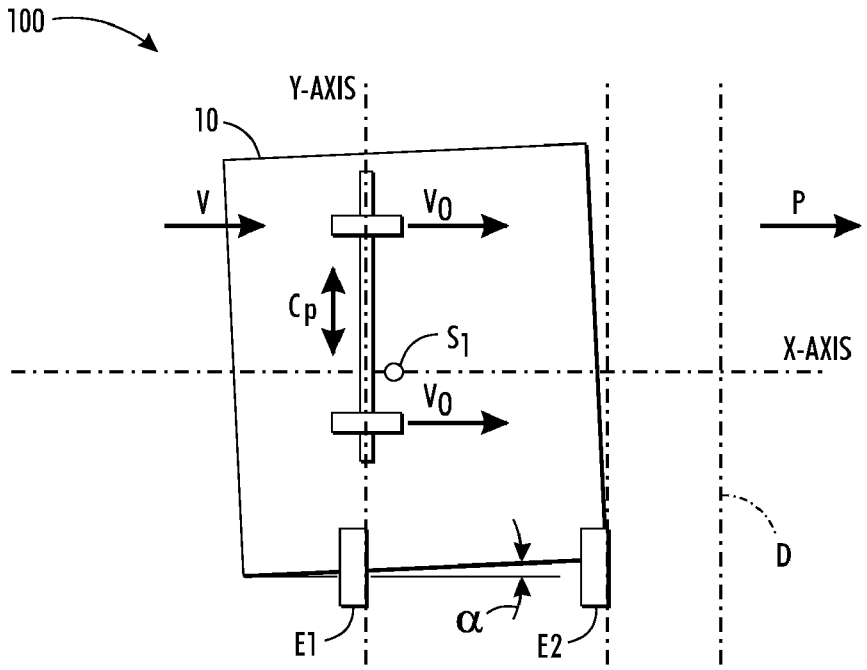
FIG. 3 is a schematic plan view as shown in FIG. 2, with the sheet having reached the downstream side edge sensor in accordance with an aspect of the disclosed technologies.
Figure 4:
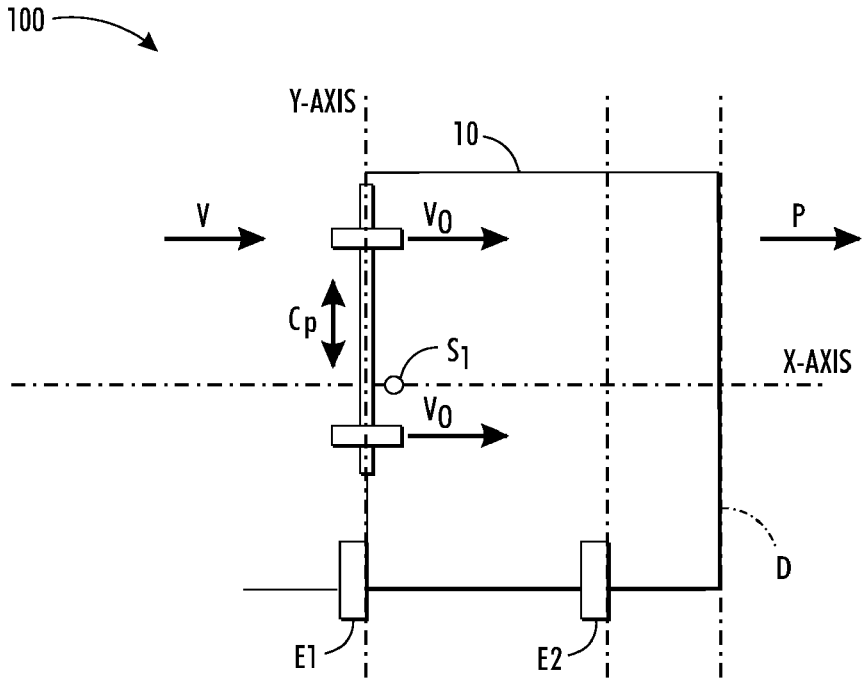
FIG. 4 is a schematic plan view as shown in FIG. 2, with the sheet having reached the datum in accordance with an aspect of the disclosed technologies.
Figure 5:
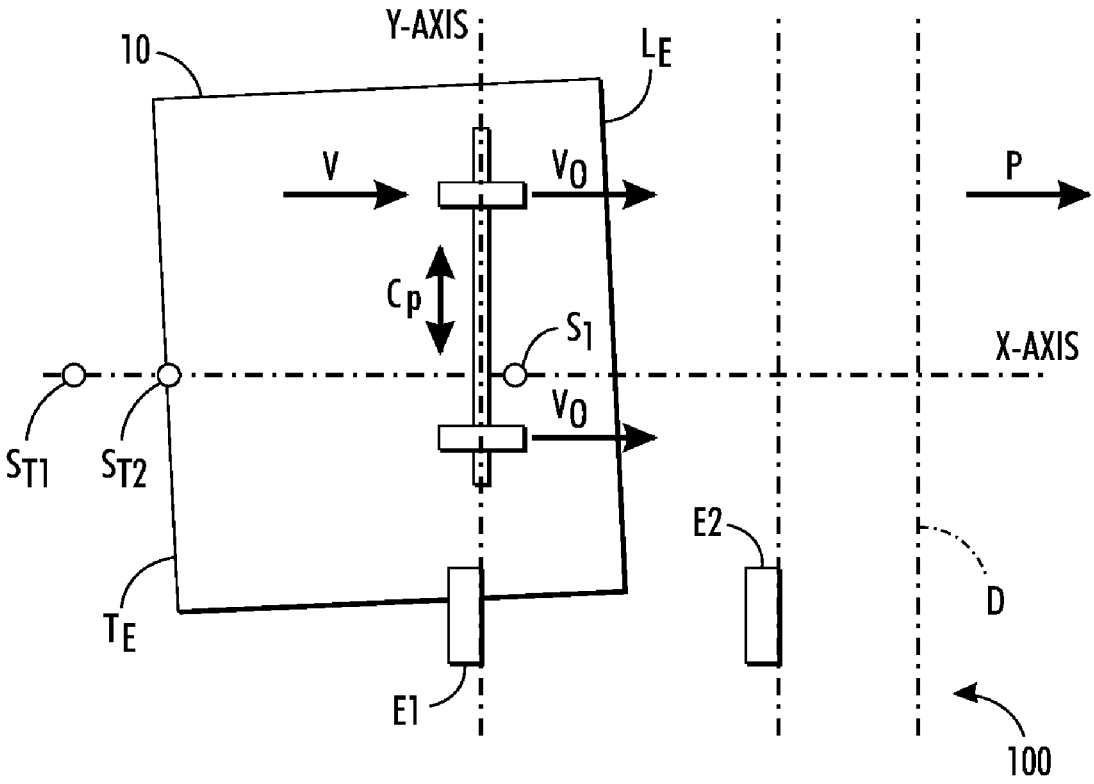
FIG. 5 is a schematic plan view as shown in FIG. 2, including trailing edge sensors in accordance with an aspect of the disclosed technologies.

FIG. 3 shows the sheet 10 having arrived at the downstream lateral edge sensor E2. At this point along the process path P further sheet edge measurements can be taken. In particular, a second position measurement of the sheet can be taken using measurements from the downstream lateral edge sensor E2 as well as a new measurement from the upstream lateral edge sensor E1. Now that two portions of a common sheet edge are being measured, sheet skew can be calculated. Based upon the offset distance Dx between the two lateral edge sensors E1, E2 and the difference in the lateral position of the two offset portions of the sheet, an initial skew angle $\alpha$ is calculated. Alternatively, based on the fact that the amount of lateral movement as a result of the first adjustment should be known. Thus, the initial measurement from sensor E1 can be compared to the subsequent measurement from sensor E2. As a further alternative, if the lateral actuator uses a stepper motor, the amount of lateral movement as part of the first adjustment would be known based on the number of steps and the incremental position per step.

Once a skew angle $\alpha$ is known for the sheet 10 at the position shown in FIG. 3, skew correction can be initiated or if previous adjustments to skew were made, further adjustments can be made at this point. Such skew correction can be an open loop or closed loop process with input now available from the two lateral edge sensors E1, E2. Using the measured and/or calculated skew angle $\alpha$, a correction to the leading edge arrival time can be determined. The controller 40 can calculate or have an associated processing device calculate a correction amount to the measured lead edge arrival time using $\alpha * Y_{lat}/V$; where $Y_{lat}$ is the lateral distance the sheet was moved as part of the first adjustment. As the angle $\alpha$ is typically very small, an approximation for the arctangent can be made. Thus, if the sheet has a skew, then a lateral movement of the sheet causes a process direction displacement at the sensor S1, for which the lead edge arrival time calculation compensates. The controller 40 can use this corrected time to execute a second adjustment of the sheet skew, velocity and/or lateral position as needed. If no adjustments were made to the sheet skew based on the initial measurements when the sheet arrived at the leading edge sensor S1, then the sheet skew can be assumed to have remained constant during the adjustment and process movement toward the downstream lateral edge sensor E2. Otherwise, if the amount of skew change over that period is known, then the average leading edge position can be calculated adjusting for the change in skew ($\alpha_1=\alpha-\Delta\alpha$; where $\alpha_1$ is the skew angle when the sheet first reaches sensor S1). Thus, the correction time for the leading edge arrival time can be calculated according to $(\alpha-\Delta\alpha)$*Ylat/V.

It should be understood that as part of the second adjustment of the sheet, further known methods can be used to ensure no process error is introduced due to a skew correction or otherwise a simple geometric calculation can establish the error and process error compensation can be done. For example, co-pending U.S. patent application Ser. No. 12/474,377 filed May 29, 2009, which is commonly assigned to Xerox Corp., discloses methods for accurately determining a leading edge position when taking into account a de-skewing action and related measurements, which is incorporated herein by reference.

Figure 6:
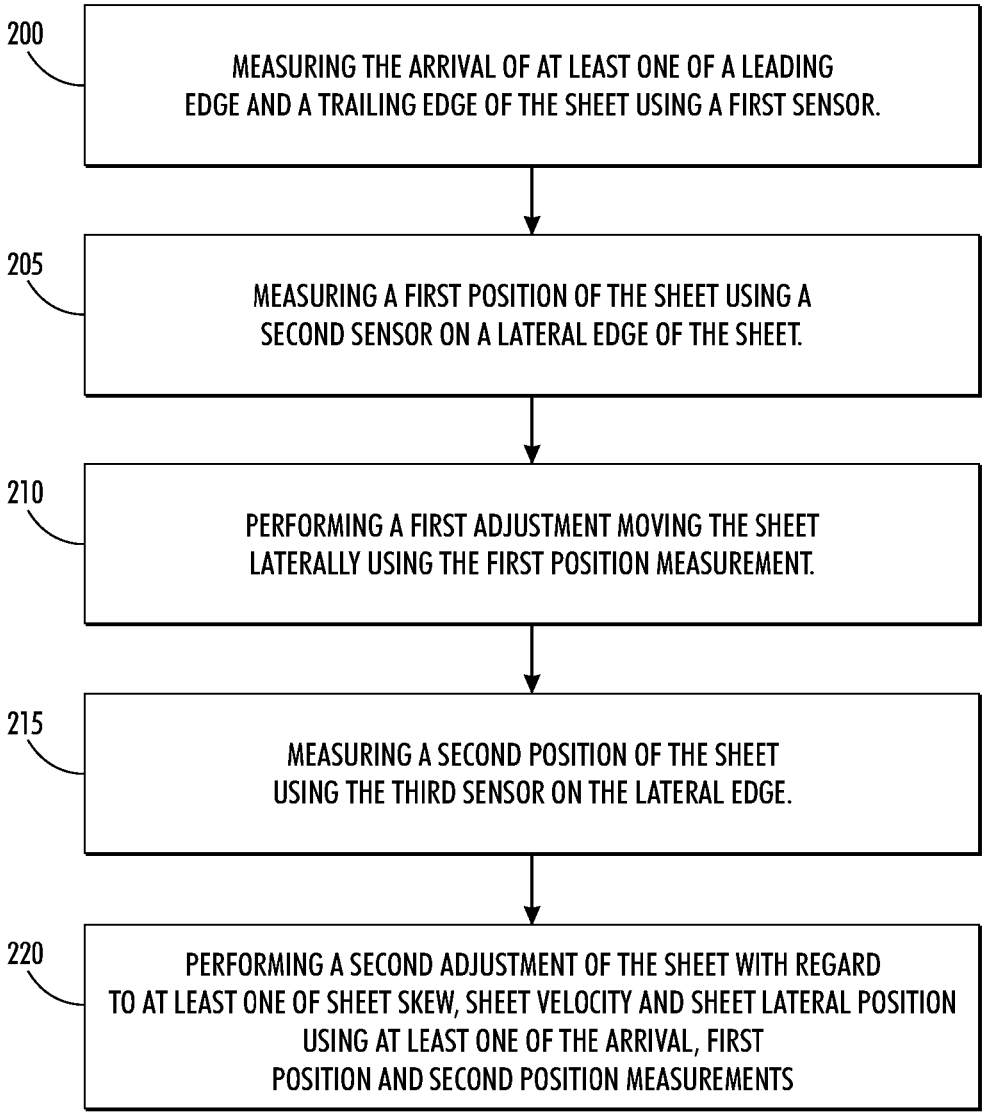
FIG. 6 illustrates a flow chart depicting a method of registering a sheet using edge sensors in accordance with aspects of the disclosed technologies.
Figure 7:
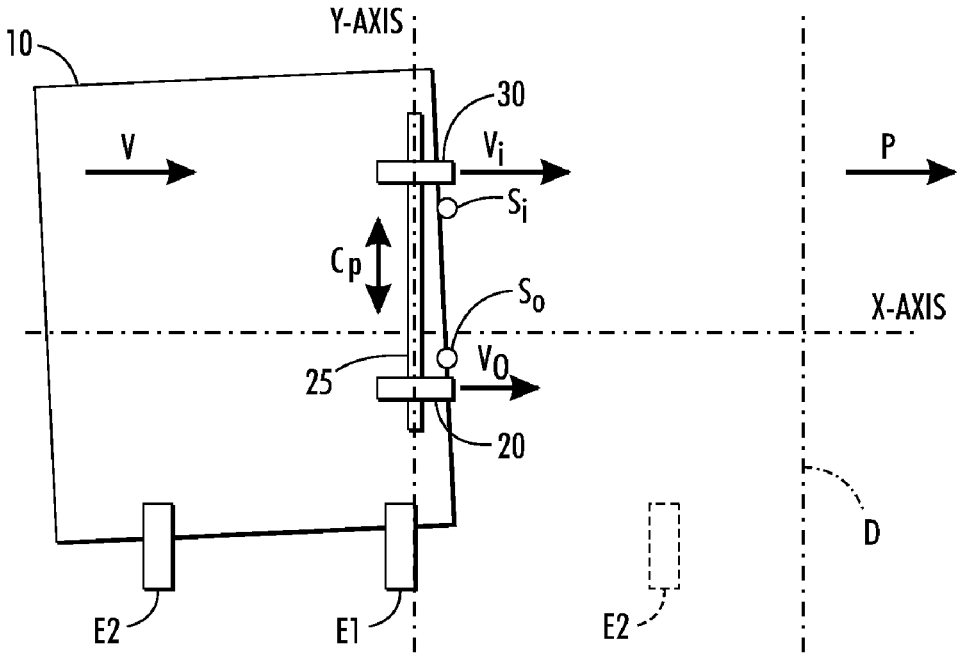
FIG. 7 PRIOR ART
FIG. 7 is a plan view of a prior art sheet registration system.

FIG. 6 shows a flowchart outlining the sheet registration method described above. It should be understood that the method described herein assumes that a substrate media handling assembly, including a sheet transport path is provided. Thus, block 200 shows that a measurement is taken of the arrival of at least one of a leading edge and a trailing edge of the sheet using a first sensor. Next, block 205 shows that a measurement is taken of a first position of the sheet using a second sensor on a lateral edge of the sheet. It should be understood that the steps of measuring the arrival 200 and measuring the first position 205 can be performed simultaneously. Block 210 then shows that a first adjustment is performed thereby moving the sheet laterally using the first position measurement. As described in the disclosure above, the first adjustment is actuated prior to the sheet reaching a third sensor for measuring a second position of the sheet. The third sensor being disposed downstream in the process direction of the second sensor and a sheet feeding nip. Block 215 shows that a second position measurement is taken of the sheet using the third sensor on the lateral edge, once the sheet reaches that third sensor. Block 220 then shows that a second adjustment of the sheet is performed. The second adjustment being relative to at least one of sheet skew, sheet velocity and sheet lateral position using at least one of the arrival, first position and second position measurements.

In a duplex print environment, it is desirable to ensure proper registration of the second side of the sheet, as well as the first side. Typically, numerous (n) trail edge sensors $S_{Tn}$ are used in order to measure the same edge measured by the leading edge sensor S1 for side one. More than half a dozen such trailing edge sensors $S_{Tn}$ are used in order to account for the different sheet lengths that can be used in these media handling assemblies. In accordance with an aspect of the disclosed technologies herein, the number of trail edge sensors $S_{Tn}$ is dependent upon a ratio of the difference between the maximum and minimum sheet length (Lmax and Lmin) and the lateral edge sensor offset distance Dx. That difference in sheet length is referred to as the sheet length differential (Lmax−Lmin). Thus, the number of trailing edge sensors used is calculated according to: n=(Lmax−Lmin)/Dx. The offset distance Dx is used as it represents the distance between the starting point of the first sheet adjustment and the starting point of the second sheet adjustment. When, a sheet has reached the sensor E2 location, the trail edge $T_E$ of the sheet must have crossed the most upstream trailing edge sensor $S_{T1}$. When the sheet lead edge $L_E$ is between the first edge sensor E1 and the second edge sensor E2, a trailing edge $T_E$ of the sheet should have crossed the first trailing edge sensor $S_{T1}$. In order to ensure this occurs, the trailing edge sensors should be spaced apart no more than the distance Dx, which extends between the first and second edge sensors E1, E2. The number of sensors depends more on the range of sheet lengths used in the system. For example, if Lmax=19 inches, Lmin=7 inches and Dx=4 inches, then the number of trail edge sensors would equal 3 (n=3). This is roughly half to a third of the number of trail edge sensors that are typically used in contemporary systems.

Often media handling assembly, and particularly printing systems, include more than one module or station. Accordingly, more than one registration system 10 as disclosed herein can be included in an overall media handling assembly. Further, it should be understood that in a modular system or a system that includes more than one registration system 10, in accordance with the disclosed technologies herein, could detect sheet mis-registration and relay that information to a central processor for controlling registration, including skew, lateral position or even velocity errors in the overall media handling assembly. Thus, if the skew, sheet position or velocity is incorrect for registration system 10 to correct, then correction can be achieved with the use one or more subsequent downstream registration systems 10, for example in another module or station.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of registering a sheet moved substantially in a process direction along a substrate media handling assembly path, a lateral direction extending sideways relative to the process direction, the method comprising:

measuring the arrival of at least one of a leading edge and a trailing edge of the sheet using a first sensor;

measuring a first position of the sheet using a second sensor on a lateral edge of the sheet;

performing a first adjustment moving the sheet laterally using the first position measurement, the first adjustment actuated by a sheet feeding nip prior to the sheet reaching a third sensor for measuring a second position of the sheet, the third sensor disposed downstream in the process direction of the second sensor and the sheet feeding nip;

measuring a second position of the sheet using the third sensor on the lateral edge; and performing a second adjustment of the sheet with regard to at least one of sheet skew, sheet velocity and sheet lateral position using the second position measurement and the sheet feeding nip, wherein the first sensor is one of a plurality of trailing edge sensors, whereby the number of trailing edge sensors included is determined by a ratio of a sheet length differential over a distance between the third sensor and the sheet feeding nip.

2. The method of claim 1, wherein the first adjustment is substantially complete by the time the sheet reaches the third sensor.

3. The method of claim 1, wherein the first adjustment is completed prior to the sheet reaching the third sensor.

4. The method of claim 1, wherein the second position measurement is taken by the second and third sensors upon the sheet reaching the third sensor.

5. The method of claim 1, wherein the second adjustment is executed using the arrival measurement to modify the sheet process velocity.

6. The method of claim 1, wherein the substrate media handling assembly path includes duplex sheet inversion, the first sensor measurement of the sheet arrival measuring the leading edge for a first sheet side before duplex sheet inversion and the first sensor measurement of the sheet arrival measuring the trailing edge for an opposed second sheet side after duplex sheet inversion.

7. The method of claim 1, wherein the arrival measurement coincides with the sheet being engaged by the sheet feeding nip.

8. The method of claim 1, wherein the third sensor is disposed closer in the process direction to a downstream delivery datum than to the sheet feeding nip.

9. The method of claim 1, wherein a constant sheet velocity is maintained as part of the first adjustment.

10. An apparatus for registering a sheet moved substantially in a process direction along a substrate media handling assembly path, a lateral direction extending sideways relative to the process direction, the apparatus comprising:

a first sensor measuring the arrival of at least one of a leading edge and a trailing edge of the sheet;

a second sensor measuring a first position of a lateral edge of the sheet;

a third sensor measuring at least one second position of the lateral edge of the sheet, the third sensor disposed downstream in the process direction of the second sensor and a sheet feeding nip; and a controller operatively connected to the sheet feeding nip and the first, second and third sensors, wherein the controller initiates a first adjustment moving the sheet laterally using the first position measurement, the first adjustment actuated by the sheet feeding nip prior to the sheet reaching the third sensor, wherein the controller initiates a second adjustment of the sheet with regard to at least one of sheet skew, sheet velocity and sheet lateral position using the second position measurement and the sheet feeding nip, wherein the first sensor is one of a plurality of trailing edge sensors, whereby the number of trailing edge sensors included is determined by a ratio of a sheet length differential over a distance between the third sensor and the sheet feeding nip.

11. The apparatus of claim 10, wherein the first adjustment is substantially complete by the time the sheet reaches the third sensor.

12. The apparatus of claim 10, wherein the first adjustment is completed prior to the sheet reaching the third sensor.

13. The apparatus of claim 12, wherein the second position measurement is taken by the second and third sensors upon the sheet reaching the third sensor.

14. The apparatus of claim 10, wherein the second adjustment is executed using the arrival measurement to modify the sheet process velocity.

15. The apparatus of claim 10, wherein the substrate media handling assembly path includes duplex sheet inversion, the first sensor measurement of the sheet arrival measuring the leading edge for a first sheet side before duplex sheet inversion and the first sensor measurement of the sheet arrival measuring the trailing edge for an opposed second sheet side after duplex sheet inversion.

16. The apparatus of claim 10, wherein the arrival measurement coincides with the sheet being engaged by the sheet feeding nip.

17. The apparatus of claim 10, wherein the third sensor is disposed closer in the process direction to a downstream delivery datum than to the sheet feeding nip.

18. The apparatus of claim 10, wherein a constant sheet velocity is maintained as part of the first adjustment.

* * * * *